US010794162B2

(12) United States Patent
Stolboushkin et al.

(10) Patent No.: US 10,794,162 B2
(45) Date of Patent: Oct. 6, 2020

(54) METHOD FOR REAL TIME FLOW CONTROL ADJUSTMENT OF A FLOW CONTROL DEVICE LOCATED DOWNHOLE OF AN ELECTRIC SUBMERSIBLE PUMP

(71) Applicants: Eugene Stolboushkin, Houston, TX (US); Aaron C. Hammer, Houston, TX (US); Jason Allen, Houston, TX (US); Ian Mitchell, Radford, VA (US); Joshua Raymond Snitkoff, Houston, TX (US)

(72) Inventors: Eugene Stolboushkin, Houston, TX (US); Aaron C. Hammer, Houston, TX (US); Jason Allen, Houston, TX (US); Ian Mitchell, Radford, VA (US); Joshua Raymond Snitkoff, Houston, TX (US)

(73) Assignee: BAKER HUGHES, A GE COMPANY, LLC, Houston, TX (US)

( * ) Notice: Subject to any disclaimer, the term of this patent is extended or adjusted under 35 U.S.C. 154(b) by 5 days.

(21) Appl. No.: 15/838,817

(22) Filed: Dec. 12, 2017

(65) Prior Publication Data

US 2019/0178065 A1 Jun. 13, 2019

(51) Int. Cl.
*E21B 43/12* (2006.01)
*E21B 47/07* (2012.01)
(Continued)

(52) U.S. Cl.
CPC ..... *E21B 43/128* (2013.01); *E21B 34/06* (2013.01); *E21B 34/14* (2013.01);
(Continued)

(58) Field of Classification Search
CPC ..... E21B 43/12; E21B 43/128; E21B 34/06; E21B 2034/007; E21B 34/14; E21B 43/2406; E21B 2049/085; E21B 23/002
See application file for complete search history.

(56) References Cited

U.S. PATENT DOCUMENTS 5,305,209 A 4/1994 Stein et al.
5,413,175 A 5/1995 Edmunds
(Continued)

FOREIGN PATENT DOCUMENTS

CA 2902548 A1 2/2017
CA 2940953 A1 2/2017
(Continued)

OTHER PUBLICATIONS

International Search Report and Written Opinion for International Application No. PCT/US2018/060049; International Filing Date Nov. 9, 2018; dated Mar. 4, 2019 (pp. 1-6).
(Continued)

*Primary Examiner* — Michael R Wills, III
(74) *Attorney, Agent, or Firm* — Cantor Colburn LLP

(57) ABSTRACT

A method of controlling flow in a tubular including developing a pressure in the tubular with an electric submersible pump (ESP), directing a flow of fluid through a flow control device arranged on the tubular downhole of the ESP in response to the pressure, sensing a parameter of the flow of fluid, and adjusting, in real time, a flow parameter of the flow control device with a coil tubing in response to the parameter of the fluid.

13 Claims, 5 Drawing Sheets

(51) Int. Cl.

| | |
|---|---|
| ***E21B 43/24*** | (2006.01) |
| ***E21B 34/14*** | (2006.01) |
| ***E21B 34/06*** | (2006.01) |
| *E21B 49/08* | (2006.01) |

(52) U.S. Cl.
CPC ..... *E21B 43/2408* (2013.01); *E21B 47/07* (2020.05); *E21B 49/0875* (2020.05)

(56) References Cited

U.S. PATENT DOCUMENTS

| | | | | |
|---|---|---|---|---|
| 6,354,378 | B1 * | 3/2002 | Patel | E21B 21/103 166/321 |
| 7,597,150 | B2 | 10/2009 | Clem | |
| 8,210,258 | B2 | 7/2012 | O'Malley et al. | |
| 8,469,105 | B2 | 6/2013 | O'Malley et al. | |
| 8,469,107 | B2 | 6/2013 | O'Malley | |
| 9,598,929 | B2 * | 3/2017 | Patel | E21B 34/06 |
| 9,638,000 | B2 | 5/2017 | Dyck | |
| 9,644,461 | B2 | 5/2017 | Castillo et al. | |
| 2002/0069022 | A1 | 6/2002 | Fincke | |
| 2005/0072567 | A1 | 4/2005 | Steele et al. | |
| 2009/0301732 | A1 * | 12/2009 | Turner | E21B 23/00 166/374 |
| 2009/0314499 | A1 * | 12/2009 | Bussear | E21B 34/14 166/386 |
| 2010/0314103 | A1 | 12/2010 | Crossley et al. | |
| 2011/0139453 | A1 | 6/2011 | Schultz et al. | |
| 2013/0048274 | A1 | 2/2013 | Schultz et al. | |
| 2014/0166280 | A1 | 6/2014 | Stone et al. | |
| 2014/0216732 | A1 | 8/2014 | Stone et al. | |
| 2015/0041129 | A1 * | 2/2015 | Mani | E21B 43/243 166/272.3 |
| 2015/0047847 | A1 | 2/2015 | Mazyar et al. | |
| 2015/0159478 | A1 | 6/2015 | Georgi et al. | |
| 2015/0218922 | A1 | 8/2015 | Gano | |
| 2015/0247391 | A1 | 9/2015 | Oliva et al. | |
| 2015/0267522 | A1 | 9/2015 | Frederick et al. | |
| 2015/0354330 | A1 | 12/2015 | Stahl et al. | |
| 2016/0063146 | A1 | 3/2016 | Bailey et al. | |
| 2016/0098502 | A1 | 4/2016 | Havre et al. | |
| 2016/0186501 | A1 * | 6/2016 | Livescu | E21B 47/0002 166/250.01 |
| 2016/0281494 | A1 | 9/2016 | Shirdel et al. | |
| 2016/0369571 | A1 | 12/2016 | Banerjee | |
| 2016/0369591 | A1 | 12/2016 | Vachon | |
| 2016/0376873 | A1 | 12/2016 | Vachon | |
| 2017/0058655 | A1 | 3/2017 | Lastiwka | |
| 2017/0307772 | A1 | 10/2017 | Jutila et al. | |
| 2017/0314367 | A1 | 11/2017 | Vachon | |
| 2018/0004864 | A1 | 1/2018 | Chainer et al. | |
| 2018/0087358 | A1 | 3/2018 | Conn et al. | |
| 2019/0145220 | A1 * | 5/2019 | Patel | E21B 34/10 166/375 |
| 2019/0169982 | A1 | 6/2019 | Hauge et al. | |
| 2019/0178068 | A1 | 6/2019 | Stolboushkin | |
| 2019/0178069 | A1 | 6/2019 | Stolboushkin | |

FOREIGN PATENT DOCUMENTS

| | | | |
|---|---|---|---|
| CA | 2983541 | A1 | 12/2017 |
| WO | WO2011098328 | A2 | 8/2011 |

OTHER PUBLICATIONS

International Search Report and Written Opinion for International Application No. PCT/US2018/060055; International Filing Date Nov. 9, 2018; dated Feb. 1, 2019 (pp. 1-9).

International Search Report and Written Opinion for International Application No. PCT/US2018/060059; International Fililing Date Nov. 9, 2018; dated Mar. 4, 2019 (pp. 1-6).

International Search Report and Written Opinion for International Application No. PCT/US2018/060063; International Filing Date Nov. 9, 2018; dated Feb. 19, 2019 (pp. 1-13).

LeCoffre, Yves "Applications of Cavitation", Cavitation Bubble Trackers, 1999, Chapter 15, pp. 363-367.

Samson AG "Cavitation in Control Valves" Control Valves, 2003, 64 pages.

Wilson, Adam "Simulation of Flow-Control Devices with Feedback Control for Thermal Operations", Journal of Petroleum Technology, 2014, pp. 69-70.

* cited by examiner

METHOD FOR REAL TIME FLOW CONTROL ADJUSTMENT OF A FLOW CONTROL DEVICE LOCATED DOWNHOLE OF AN ELECTRIC SUBMERSIBLE PUMP

BACKGROUND

Stimulation operations are commonly employed in the energy industry to facilitate hydrocarbon production from formations. Examples of stimulations include hydraulic fracturing, acid stimulation, steam injection, thermal injection and other operations that include injection of fluids and/or heat into a formation.

An example of a steam injection process is referred to as Steam Assisted Gravity Drainage (SAGD), which is a technique for recovering formation fluids such as heavy crude oil and/or bitumen from geologic formations, and generally includes heating the bitumen through an injection borehole until it has a viscosity low enough to allow it to flow into a recovery borehole. As used herein, "bitumen" refers to any combination of petroleum and matter in the formation and/or any mixture or form of petroleum, specifically petroleum naturally occurring in a formation that is sufficiently viscous as to require some form of heating or diluting to permit removal from the formation.

Often times, an electric submersible pump (ESP) is employed to urge the formation fluids to a surface collection point. The formation fluids flow through one or more flow control devices into a production tubular. The ESP creates a force that draws the formation fluids through the flow control device(s) and upwardly. The flow control devices are typically arranged downhole of the ESP and thus set before being run into a wellbore.

Once the ESP is deployed, access to the flow control device(s) is cut off and thus adjustments to the flow control device(s) are not readily possible. If adjustments are desired, it is necessary to stop production, withdraw the production tubular and make any desired flow adjustments. Accordingly, the industry would be receptive to a system that enabled access to and real-time adjustment of, a flow control device in a production tubular.

SUMMARY

Disclosed is a method of controlling flow in a tubular including developing a pressure in the tubular with an electric submersible pump (ESP), directing a flow of fluid through a flow control device arranged on the tubular downhole of the ESP in response to the pressure, sensing a parameter of the flow of fluid, and adjusting, in real time, a flow parameter of the flow control device with a coil tubing in response to the parameter of the fluid.

Also disclosed is a resource recovery and exploration system including a valve assembly and a plurality of tubulars fluidically connected to the valve assembly. At least one of the plurality of tubulars defines a collector having at least one selectively adjustable flow control device. An electric submersible pump (ESP) is fluidically connected to collector uphole relative to the at least one selectively controllable flow control device. A conduit extends along the plurality of tubulars. The conduit has a terminal end arranged downhole of the ESP. A shifting tool is coupled to the terminal end section of the conduit.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method are presented herein by way of exemplification and not limitation with reference to the Figures.

Systems and methods are provided for performing production operations, monitoring production operations and detecting breakthrough of injected fluid from an injection assembly to a production or collection assembly. At least part of a distributed measurement system, such as a fiber optic distributed temperature and/or acoustic sensing assembly, is disposed in a collector and/or an injector and measures one or more parameters related to breakthrough of injected fluid into the collector. In one embodiment, the injector is configured to inject a thermal source such as steam, which causes hydrocarbons in a formation to move or migrate toward the collector.

In one embodiment, measured parameter values (e.g., temperature, vibration and/or strain) are acquired from a distributed fiber optic sensor disposed along a longitudinal axis of the collector. The measured parameter values are used to generate a parameter profile. A portion of the profile having measurement values outside of a selected range (e.g., a threshold measurement value or threshold increase in a measurement value) is considered to be indicative of breakthrough. Operational parameter adjustments may be performed in response to detecting breakthrough. For example, a flow control device in a production zone associated with the portion of the parameter profile may be closed or adjusted to restrict or completely stop fluid flow therethrough.

Figure 1:
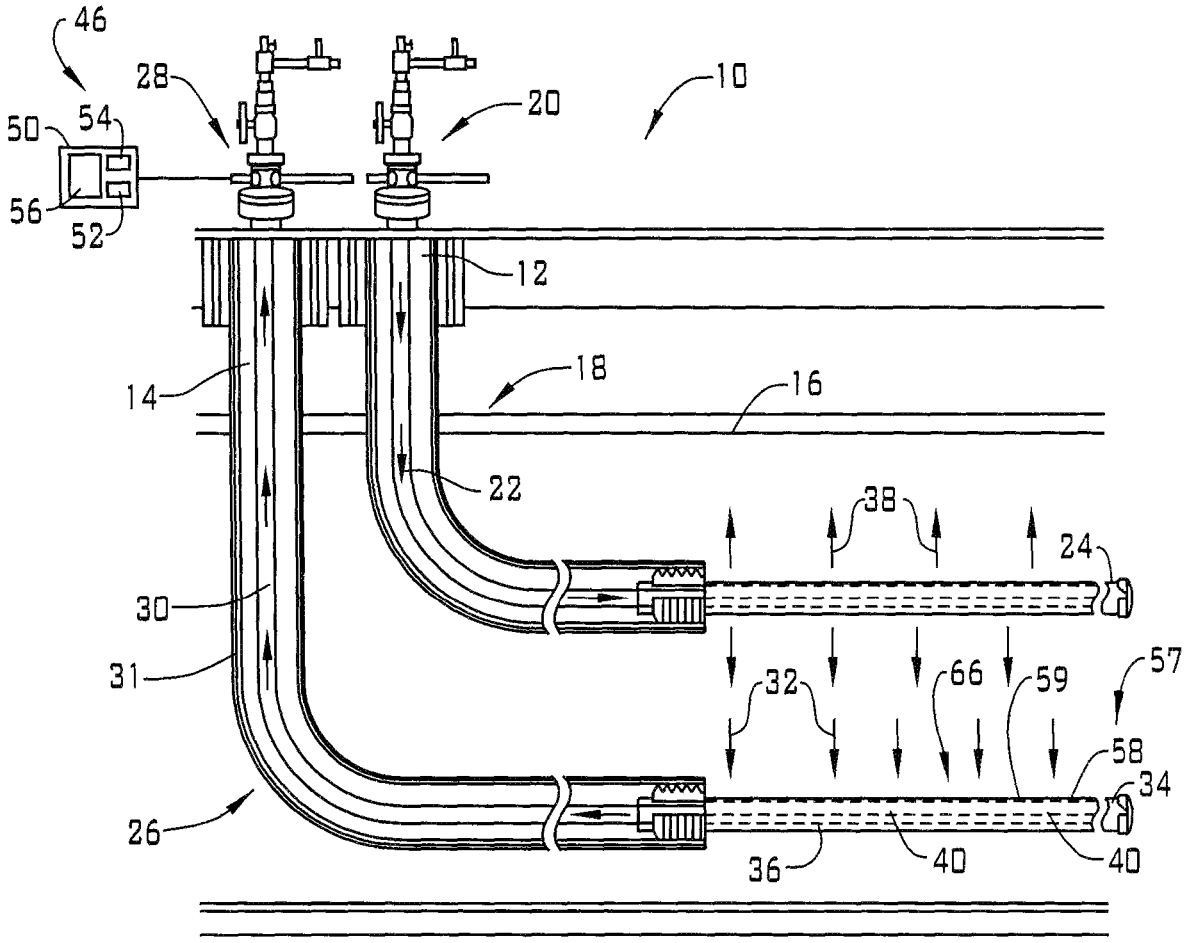
FIG. 1 depicts a resource recovery and exploration system including a collector, in accordance with an aspect of an exemplary embodiment.

Referring to FIG. 1, an embodiment of a formation production system 10 includes a first borehole 12 and a second borehole 14 extending into a resource bearing formation such as an earth formation 16. In one embodiment, the formation is a hydrocarbon bearing formation or strata that includes, e.g., oil and/or natural gas. The first borehole 12 (also referred to as the injector borehole or injector well) includes an injection assembly 18 having an injection valve assembly 20, an injection conduit 22 and an injector 24. The injection valve assembly 20 is configured to introduce or inject a fluid (referred to as an injected fluid) such as a stimulation fluid to the earth formation 16.

A production assembly 26 is disposed in the second borehole 14, and includes a production valve assembly 28 connected to a plurality of tubulars that may take the form of a production conduit 30. Production conduit 30 is arranged radially inwardly of a casing 31. Production fluid 32, which may include hydrocarbons and other fluids (e.g., the injected fluid, water, non-hydrocarbon gases, etc.) flows into a collector 34 via a plurality of openings such as slots 36, and flows through the production conduit 30 to a suitable container or other location.

In the embodiment of FIG. 1, the boreholes 12 and 14, the injector 24 and/or the collector 34 are disposed generally horizontally through a formation stratum, and can extend to various distances, often one kilometer or more. However, embodiments described herein are not so limited, as the boreholes and/or components therein can extend along any selected path, which can include vertical, deviated and/or horizontal sections.

In one embodiment, the system 10 is configured as a steam injection system, such as a steam assisted gravity drainage (SAGD) system. SAGD methods are typically used to produce heavy oil (bitumen) from formations and/or layers, such as layers that are too deep for surface mining. The injected fluid in this embodiment includes steam 38, which is introduced into the earth formation 16 via the injector 24. The steam 38 heats a region in the formation, which reduces the viscosity of hydrocarbons therein, allowing the hydrocarbons to drain into the collector 34. For example, the injected steam condenses into a phase that includes a liquid water and hydrocarbon emulsion, which flows as a production fluid into the collector 34. A steam head (not separately labeled) may be maintained above the collector 34 to maintain the process of heating the region. The earth formation 16 may include regions having bitumen and/or heavy crude oil. For example, earth formation 16 may include a tar sands region (also not separately labeled).

In one embodiment, one or more flow control devices 40 are positioned at selected sections along the collector 34 to control the rate of fluid flow through the collector 34. Examples of flow control devices include active inflow control devices (ICDs), passive flow control devices, screens, valves, sleeves and others. Other components, such as packers, may be included in the collector 34 to establish production zones.

Surface and/or downhole components such as the injection valve assembly 20, the production valve assembly 28, the injector 24, the collector 34 and/or the flow control devices 40 may be in communication with a processing device 46. For example, downhole components communicate with a processing device 46 that may take the form of a surface processing unit 50 and/or downhole electronics. The processing device 46 includes components for performing functions including communication, data storage, data processing and/or control of components. For example, the surface processing unit 50 includes an input/output unit 52, a processor 54 (e.g., a microprocessor) and memory 56 to store data, models and/or computer programs or software. The processing device may be configured to perform functions such as controlling deployment of downhole components, controlling operation of components, transmitting and receiving data, processing measurement data and/or monitoring operations.

Various tools and/or sensors may be incorporated in the system. For example, one or more measurement tools can be deployed downhole for measuring parameters, properties or conditions of the borehole, formation and/or downhole components. Examples of sensors include temperature sensors, pressure sensors, flow measurement sensors, resistivity sensors, porosity sensors (e.g., nuclear sensors or acoustic sensors), fluid property sensors and others.

In one embodiment, the system 10 includes a production monitoring system 57 configured to monitor the flow of production fluid into the collector 34 and/or detect instances of breakthrough of steam or other injected fluids from the formation into the collector 34. The production monitoring system 57 includes a distributed sensing assembly 58 configured to measure parameters or conditions that can be indicative of breakthrough. The distributed sensing assembly 58 can measure conditions such as temperature, pressure and/or vibration and detect the presence or onset of breakthrough in one or more sections or zones along the collector 34.

In one embodiment, the distributed sensing assembly 58 includes a fiber optic sensor 59, which includes one or more optical fibers. The fiber optic sensor 59 may take the form of a distributed measurement assembly that extends along a selected length of the second borehole 14 and/or the collector 34 and is configured to generate signals indicative of a selected parameter. For example, the fiber optic sensor 59 (or a length thereof) extends generally along a longitudinal axis (not separately labeled) of the collector 34.

Signals from the fiber optic sensor 59 are received by a processing device (e.g., the surface processing unit 50) and analyzed to generate measurement values. The measurement values can be for example, backscatter intensity values and/or parameter values (e.g., temperature values) derived from the intensity values. In one embodiment, the processing device generates a parameter profile, which may be continuous curve and/or a set of discrete parameter values corresponding to a plurality of locations along a length of the second borehole 14 and/or the collector 34. The profile may be indicative of one or more parameters related to or indicative of breakthrough or conditions associated with breakthrough. Examples of such parameters include temperature, pressure, strain, vibration and acoustic properties.

The fiber optic sensor 59 may be disposed at any suitable location relative to the collector 34. For example, as shown in FIG. 1, the fiber optic sensor 59 can be disposed along a surface of the collector 34 (e.g., in a bore through the wall of the collector 34 or in a conduit such as a metal tube attached to the interior or exterior surface of the collector 34.

In one embodiment, the production monitoring system 57 is configured as a temperature measurement system (not separately labeled) that includes a distributed temperature sensing (DTS) assembly (also not separately labeled). The DTS assembly utilizes Spontaneous Raman Scattering (SRS) in optically transparent material in an optical fiber sensor to measure temperature. Raman backscatter is caused by molecular vibration in the optical fiber as a result of incident light, which causes emission of photons that are shifted in wavelength relative to the incident light. Positively shifted photons, referred to as Stokes backscatter, are independent of temperature. Negatively shifted photons, referred to as Anti-Stokes backscatter, are dependent on temperature. An intensity of anti-Stokes backscatter, and/or a ratio of Stokes to Anti-Stokes back-scatter may be used to calculate temperature.

In one embodiment, the production monitoring system 57 may take the form of an acoustic or strain measurement system (not separately labeled), such as a distributed acoustic sensing (DAS) system (also not separately labeled). Distributed acoustic sensing (DAS) uses pulses of light from a highly coherent electromagnetic source (e.g., laser) to measure vibrations sensed by an optical fiber such as the fiber optic sensor 59. Light in the fiber naturally undergoes Rayleigh scattering as it propagates down the fiber and light scattering from different sections of the fiber can interfere with each other. By looking at the time variations in these interference signals, DAS can be used to measure the acoustic vibrations sensed by a fiber as it undergoes time varying strain. It is noted that both temperature and acoustic sensing can be performed, e.g., by separate DTS and DAS fibers or by a single optical fiber or fiber optic sensor.

Figure 2:
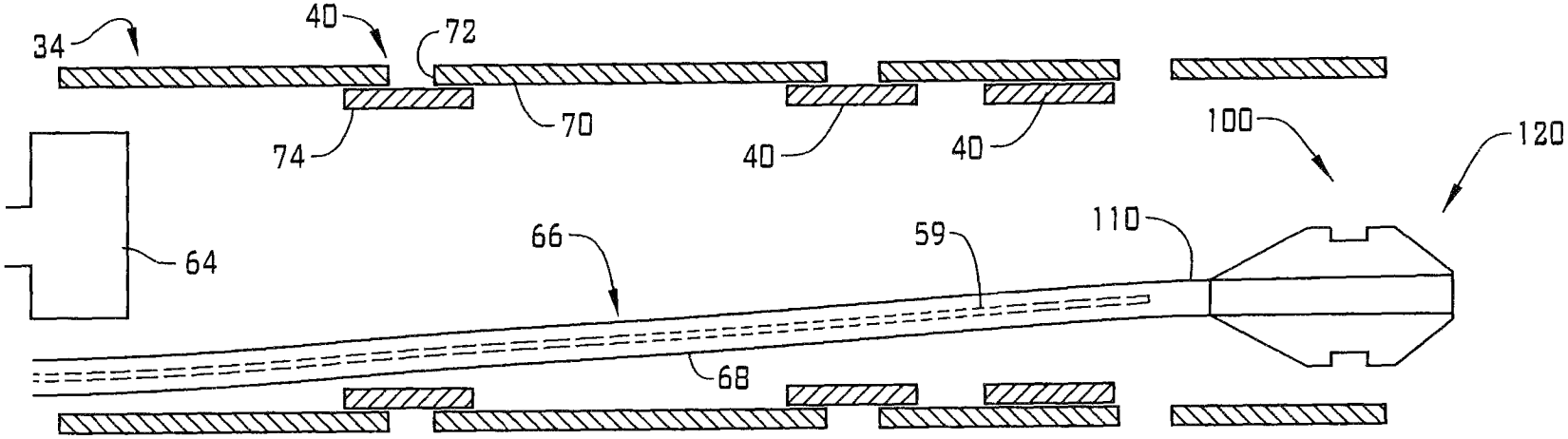
FIG. 2 depicts a shifting tool arranged in the collector of FIG. 1 downhole of an electric submersible pump, in accordance with an aspect of an exemplary embodiment.

As shown in FIG. 2, one or more production facilitation components may be included in the system 10. For example, the collector 34 can include or be connected to a downhole pumping device such as an electric submersible pump (ESP) 64. Other pumping devices that may be used include a beam pump, a jet pump, a hydraulic pump and/or a progressive cavity pump to increase the flow rate of production fluid to the surface. Other examples of production facilitation components include components for methods such as natural steam lift and gas lift.

After installation of the flow control devices 40 and the ESP 64, the fiber optic sensor 59 may be deployed into the collector 34 to measure selected parameters along one or more production zones. For example, fiber optic sensor 59 is disposed in a sensor conduit 66 such as a length of coiled tubing 68. The coiled tubing 68 can be deployed inside or alongside production conduit 30 prior to, during or after deployment of the collector 34.

Flow control device 40 may include a tubular body 70 having one or more slots or other openings 72 through which production fluid can enter the production conduit 30. The tubular body 70 may form part of the collector body or be a separate component connected or attached to the collector 34. A sleeve 74 is disposed inside the tubular body 70 and can be actuated to control the amount of fluid flow through the body 70. The sleeve 74 can be actuated to completely shut off flow, to allow full flow through the openings 72, or to partially cut off flow. The sleeve 74 can be moved to a closed position in response to the detection of breakthrough or a detected condition indicating that breakthrough is imminent. In one embodiment, the sleeve 74 need not establish a fluid-tight seal, as the geometric restriction is sufficient to choke back flow. However, in some cases, the sleeve 74 is capable of sealing and not permitting any flow.

The sleeve 74 may have any suitable design, such as a simple open/close design, or it may have a mechanism allowing open, closed, and partially open positions in between. A j-slot or similar indexing mechanism can be used to allow positive surface indication of position. Erosion and wear resistance can be enabled by either geometry (such as by using a helical sleeve) or through material (e.g., tungsten carbide).

Figure 3:
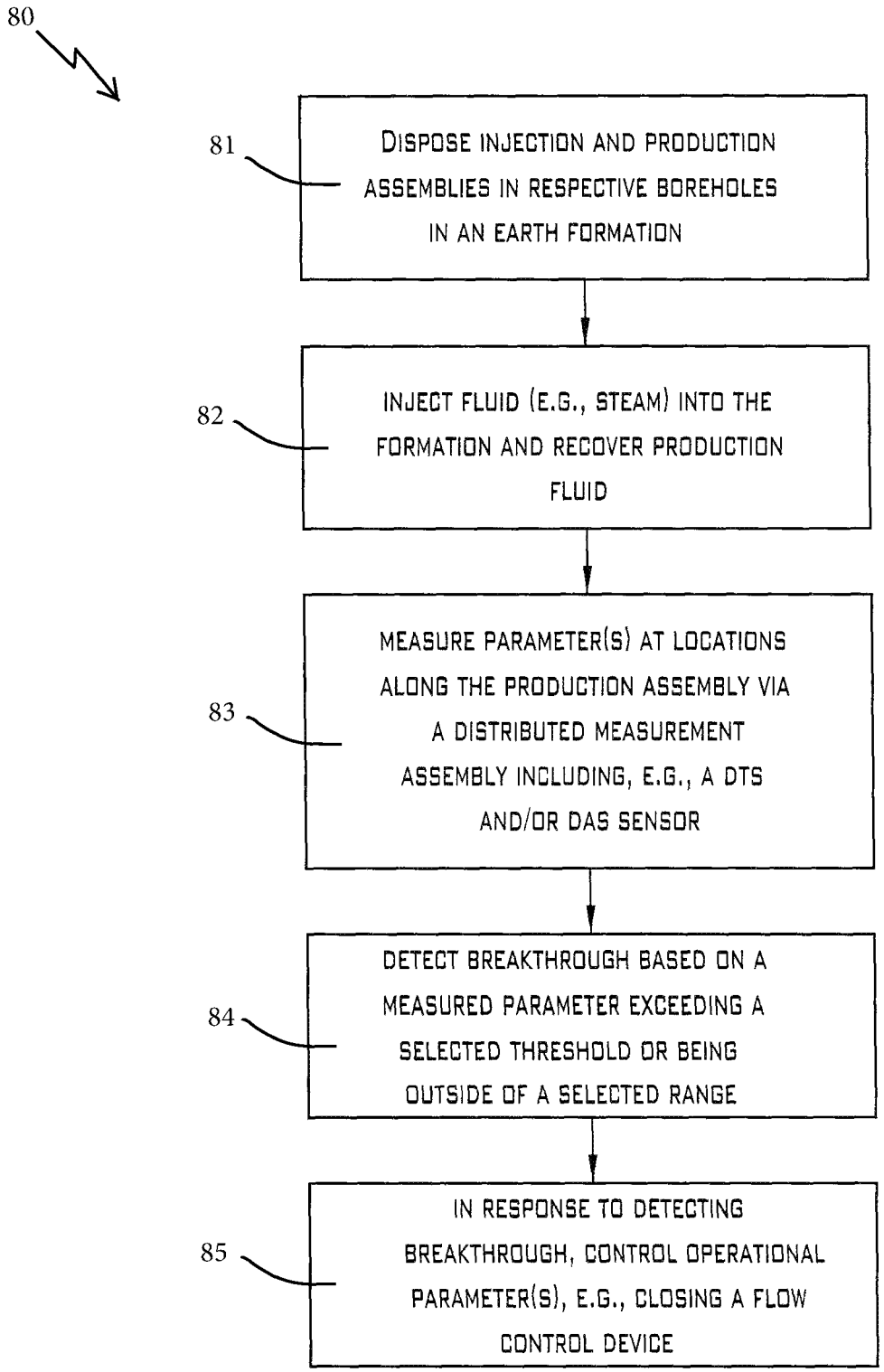
FIG. 3 is a flow diagram depicting an embodiment of a method of adjusting, in real time, a flow control device of the resource recovery and production system, in accordance with an aspect of an exemplary embodiment.

Referring to FIG. 3 and with continued reference to FIG. 2, a method 80 of producing a target resource such as hydrocarbons from a resource bearing formation and monitoring fluid flow during production includes one or more stages 81-85. In one embodiment, the method 80 includes the execution of all of stages 81-85 in the order described. However, certain stages may be omitted, stages may be added, or the order of the stages changed. Although the method 80 is described in conjunction with the system 10 and the injection and production assemblies described herein, the method 80 may be utilized in conjunction with any production system that incorporates injection of fluids for facilitating production.

In the first stage 81, the injection assembly 18 is disposed in the first borehole 12, and advanced through the first borehole 12 until the injector 24 is located at a selected location. The production assembly 26 is disposed in the second borehole 14, and advanced through the second borehole 14 until the collector 34 is positioned at a selected location. In one embodiment, the selected location is directly below, along the direction of gravity, the injector 24.

In the second stage 82, a fluid is injected into a region of the formation surrounding the first borehole 12 via the injection assembly 18 to facilitate production. Examples of injected fluid include water, brine, acid, hydraulic fracturing fluid, gases and thermal fluids. In an embodiment, the injected fluid is steam, which is injected to reduce a viscosity of hydrocarbon material such as bitumen. The hydrocarbon material migrates with the force of gravity to a region of the formation surrounding the second borehole 14, and is recovered as production fluid through openings 72 in collector 34. The flow rate of production fluid and/or the specific zones through which production fluid is allowed to flow may be controlled by one or more flow control devices (e.g., the flow control devices 40).

In the third stage 83, distributed measurements of parameters at or near the flow control devices are performed continuously or periodically during production. For example, fiber optic sensor 59 may be configured to measure temperature and/or acoustic properties of the hydrocarbon material. A parameter profile may be generated that includes measurement values as a function of depth or position along a selected section of the collector 34 and/or the first borehole 12.

In the fourth stage 84, if the measurement values at a location along the production assembly are outside of a selected range, e.g., exceed a selected threshold, breakthrough of the injected fluid is detected. In the case of steam injection, breakthrough refers to the entry of steam or water into the production assembly. It is noted that the method is not limited to steam injection, and can be used to detect the entry or breakthrough of any undesirable fluid into the collector 34.

Any suitable measurement value range can be selected. The range may be a maximum and/or minimum value threshold. Another range that can be selected includes a relative parameter value, i.e., a value of a parameter relative to other measured values in the profile. For example, the range is selected as a threshold difference between a measurement value and values at adjacent points or portions of the profile, or between a measurement value and an average or other statistical attribute of the profile.

In the fifth stage 85, in response to detecting breakthrough, one or more operational parameters may be controlled or adjusted. In one embodiment, flow control device 40 in a section or production zone associated with the breakthrough may be adjusted, in real time, as discussed herein. For example, sleeve 74 may be closed to isolate the section and prevent fluid flow therethrough. Other operational parameters may include parameters related to fluid injection. For example, the flow rate and/or volume of steam (or other injected fluid) can be reduced or stopped in response to detecting breakthrough. It should be understood that the phrase "in real time" describes that adjustments may be made without shutting down ESP 64.

Sleeve 74 may be adjusted through manipulation of a shifting tool 100 mounted to a terminal end 110 of coiled tubing 68. Shifting tool 100 may be run downhole on coil tubing 68 or, parked downhole through, for example, a guide tube (not separately labeled). Once parked, coil tubing 68 may selectively connect with and unlatch shifting tool 100.

In an exemplary embodiment, shifting tool 100 includes a sleeve manipulator portion 120 that may engage with and move sleeve 74 between an open position and a closed position. By providing shifting tool 100 on coiled tubing 68, adjustments may be made to flow control device 40 arranged downhole of ESP 64 in real time—e.g., while producing fluid. Additionally, flow control device 40 may be adjusted through, for example, manipulation of sleeve 74 based on changing conditions downhole without the need to interrupt operations to withdraw production conduit 30 or ESP 64 from second borehole 14.

Figure 4:
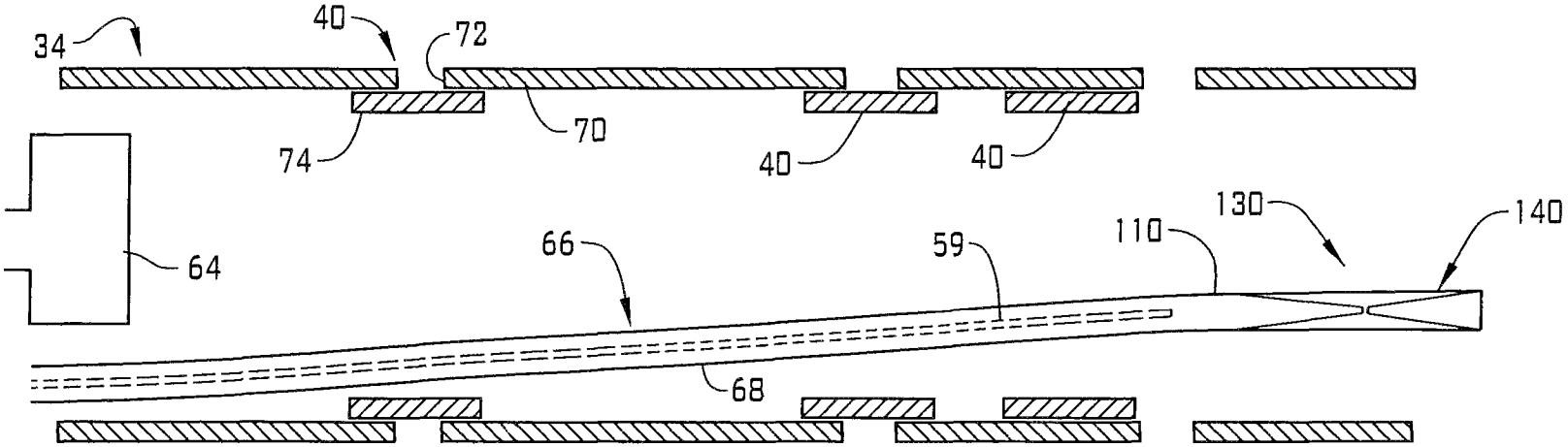
FIG. 4 depicts a shifting tool in a closed position, in accordance with an aspect of an exemplary embodiment.
Figure 5:
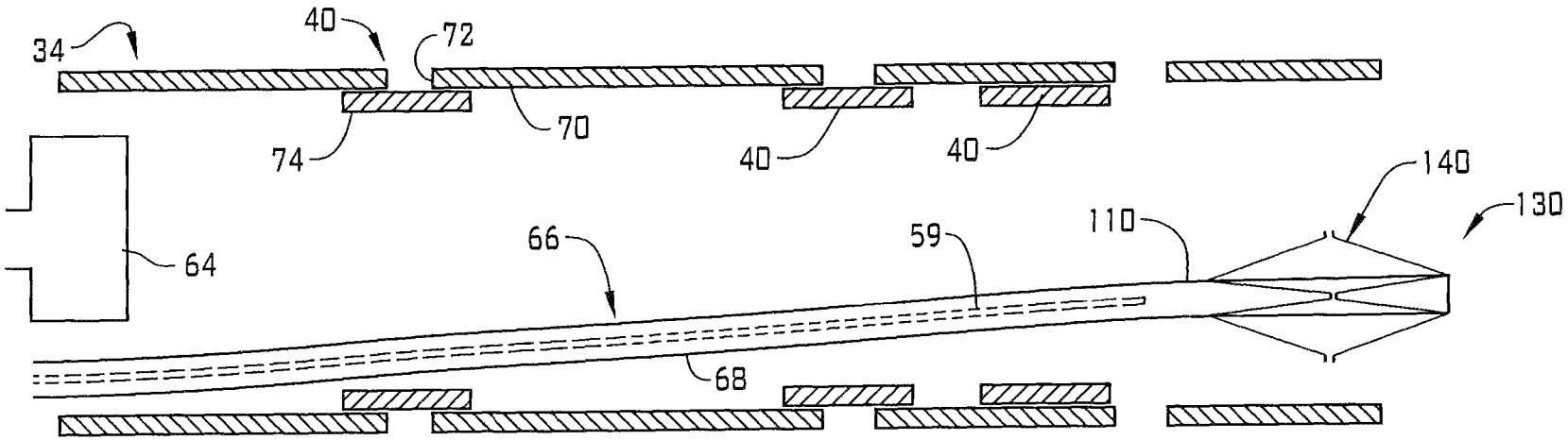
FIG. 5 depicts the shifting tool of FIG. 4 in an open or deployed configuration, in accordance with an aspect of an exemplary embodiment.

In accordance with an exemplary aspect, shifting tool 100 may be connected to coiled tubing 68 when run in to second borehole 14. In accordance with another exemplary aspect, coiled tubing 68 and shifting tool 100 may be run in separately, and then selectively connected when it is desired to adjust one or more of sleeves 74. Shifting tool 100 may then be disconnected from coiled tubing 68 if desired. In accordance with another exemplary aspect, a selectively deployable shifting tool 130 may be coupled to terminal end 110 of coiled tubing 68 as shown in FIGS. 4 and 5. Selectively deployable shifting tool 130 may include a deployable shifting member 140 that may transition between a run in configuration (FIG. 4) and a deployed configuration (FIG. 5). In the deployed configuration, deployable shifting member 140 may be manipulated through coiled tubing 68 to adjust sleeve 74.

In accordance with yet another exemplary aspect, coiled tubing 68 may support a pressure sensor (not separately labeled). The pressure sensor may be employed to measure wellbore pressures along various points of collector 34. Pressure data may be utilized to determine an amount of adjustment of one or more adjustment sleeves 74.

Although embodiments are described in conjunction with a system having a distributed sensor in a production borehole, they are not so limited. In addition to or in place of a fiber optic sensor in the production borehole, a fiber optic sensor or other distributed sensor can be disposed in an injection borehole for monitoring of parameters or conditions associated with or related to breakthrough. For example, a distributed temperature sensor and/or a distributed strain or acoustic sensor (e.g., a DTS and/or DAS fiber) can detect changes in temperature, strain and/or vibration that may be associated with breakthrough.

Embodiments described herein present a number of advantages and technical effects. For example, the system and method positively affects production from SAGD and other wells by providing real time information regarding breakthroughs, which can allow operators and/or controllers to react quickly to breakthroughs, e.g., by isolating zones subject to breakthrough and/or transferring production to more productive zones. In addition, the embodiments allow for using distributed measurement data that may already be in use for other applications (e.g., temperature and/or acoustic monitoring) to further enhance production, thereby increasing the utility and cost-effectiveness of such applications.

The embodiments allow for a targeted assessment of conditions relating to breakthrough and correspondingly targeted remediation through adjustment of a flow control device arranged downhole relative to an ESP. For example, when steam breakthrough occurs, the usual course of action available to an operator is to reduce the flow rate by reducing the ESP pump rate, and/or withdrawal of the production string or ESP to provide access to the flow control device. This will give the steam more dwell time in the sand, allowing the maintenance of the oil-water emulsion above the producer well. The embodiments allow for targeting the breakthrough sections so that only breakthrough zones are throttled back to avoid reducing production from zones with better properties.

Embodiments described herein allow for increased production from SAGD or other injection systems. In the case of SAGD systems, detection of breakthrough events and active adjustments of flow control devices can reduce or minimize the amount of steam needed, and produce higher production rates.

Set forth below are some embodiments of the foregoing disclosure:

Embodiment 1

A method of controlling flow in a tubular comprising developing a pressure in the tubular with an electric submersible pump (ESP), directing a flow of fluid through a flow control device arranged on the tubular downhole of the ESP in response to the pressure, sensing a parameter of the flow of fluid, and adjusting, in real time, a flow parameter of the flow control device with a coil tubing in response to the parameter of the fluid.

Embodiment 2

The method of any prior embodiment, wherein the parameter of the flow of fluid is selected from at least one of a fluid flow rate and a temperature of the flow of fluid.

Embodiment 3

The method of any prior embodiment, wherein sensing the parameter of the flow of fluid includes exposing a distributed measurement assembly to the flow of fluid.

Embodiment 4

The method of any prior embodiment, wherein exposing the distributed measurement assembly to the flow of fluid includes operatively exposing a fiber optic sensor arranged in the coil tubing to the flow of fluid.

Embodiment 5

The method of any prior embodiment, wherein adjusting the flow parameter of the flow control device includes adjusting the flow control device reduce fluid flow into the tubular.

Embodiment 6

The method of any prior embodiment, wherein adjusting the flow parameter with the coil tubing includes operating a shifting tool connected to a terminal end of the coil tubing.

Embodiment 7

The method of any prior embodiment, wherein operating the shifting tool connected to the terminal end of the coil tubing includes operating a shifting tool connected to a coil tubing extending past the ESP.

Embodiment 8

The method of any prior embodiment, wherein operating the shifting tool include expanding the shifting tool.

Embodiment 9

A resource recovery and exploration system comprising a valve assembly, a plurality of tubulars fluidically connected to the valve assembly, at least one of the plurality of tubulars defining a collector having at least one selectively adjustable flow control device, an electric submersible pump (ESP) fluidically connected to collector uphole relative to the at least one selectively controllable flow control device, a conduit extending along the plurality of tubulars, the conduit having a terminal end arranged downhole of the ESP, and a shifting tool coupled to the terminal end section of the conduit.

Embodiment 10

The resource recovery and exploration system according to any prior embodiment, wherein the conduit comprises coiled tubing.

Embodiment 11

The resource recovery and exploration system according to any prior embodiment, further comprising a sensor arranged in the coiled tubing.

Embodiment 12

The resource recovery and exploration system according to any prior embodiment, wherein the sensor comprises a fiber optic sensor.

Embodiment 13

The resource recovery and exploration system according to any prior embodiment, wherein the sensor comprises at least one of a distributed acoustic sensing (DAS) system and a distributed temperature sensing (DTS) assembly.

Embodiment 14

The resource recovery and exploration system according to any prior embodiment, wherein the at least one selectively adjustable flow control device includes a selectively shiftable sleeve.

Embodiment 15

The resource recovery and exploration system according to any prior embodiment, wherein the shifting tool comprises a selectively expandable shifting tool.

The use of the terms "a" and "an" and "the" and similar referents in the context of describing the invention (especially in the context of the following claims) are to be construed to cover both the singular and the plural, unless otherwise indicated herein or clearly contradicted by context. Further, it should further be noted that the terms "first," "second," and the like herein do not denote any order, quantity, or importance, but rather are used to distinguish one element from another. The modifier "about" used in connection with a quantity is inclusive of the stated value and has the meaning dictated by the context (e.g., it includes the degree of error associated with measurement of the particular quantity).

The teachings of the present disclosure may be used in a variety of well operations. These operations may involve using one or more treatment agents to treat a formation, the fluids resident in a formation, a wellbore, and/or equipment in the wellbore, such as production tubing. The treatment agents may be in the form of liquids, gases, solids, semi-solids, and mixtures thereof. Illustrative treatment agents include, but are not limited to, fracturing fluids, acids, steam, water, brine, anti-corrosion agents, cement, permeability modifiers, drilling muds, emulsifiers, demulsifiers, tracers, flow improvers etc. Illustrative well operations include, but are not limited to, hydraulic fracturing, stimulation, tracer injection, cleaning, acidizing, steam injection, water flooding, cementing, etc.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited.

What is claimed is:

1. A method of controlling flow in a tubular extending into a wellbore comprising:

developing a pressure in the tubular with an electric submersible pump (ESP);

directing a flow of fluid through a flow control device into a collector arranged on the tubular downhole of the ESP in response to the pressure;

deploying coiled tubing supporting a distributed sensor into the tubular, the coiled tubing being independent of the tubular;

sensing a parameter of the flow of fluid with the distributed sensor;

generating a parameter profile corresponding to a plurality of locations along the collector; and adjusting, in real time, a flow parameter of the flow control device with a shifting tool supported by the coiled tubing in response to the parameter of the fluid.

2. The method of claim 1, wherein the parameter of the flow of fluid is selected from at least one of a fluid flow rate and a temperature of the flow of fluid.

3. The method of claim 1, wherein sensing the parameter of the flow of fluid includes exposing a distributed sensor to the flow of fluid.

4. The method of claim 3, wherein exposing the distributed sensor to the flow of fluid includes operatively exposing a fiber optic sensor arranged in the coiled tubing to the flow of fluid.

5. The method of claim 1, wherein adjusting the flow parameter of the flow control device includes adjusting the flow control device reduce fluid flow into the tubular.

6. The method of claim 1, wherein adjusting the flow parameter with the coiled tubing includes operating the shifting tool connected to coiled tubing extending past the ESP.

7. The method of claim 1, wherein operating the shifting tool includes expanding the shifting tool.

8. The method of claim 1, wherein generating the parameter profile includes detecting a breakthrough of an injected fluid into the collector based on the parameter profile.

9. A resource recovery and exploration system comprising:

a valve assembly;

a plurality of tubulars fluidically connected to the valve assembly, at least one of the plurality of tubulars defining a collector having at least one selectively adjustable flow control device;

an electric submersible pump (ESP) fluidically connected to collector uphole relative to the at least one selectively controllable flow control device;

a coiled tubing extending along and independent of the plurality of tubulars, the coiled tubing having a terminal end arranged downhole of the ESP and supporting a distributed sensor;

a shifting tool coupled to the terminal end section of the coiled tubing the shifting tool being configured to adjust the selectively adjustable flow control device; and a processing device operatively connected to the distributed sensor, the processing device generating a parameter profile corresponding to a plurality of locations along the collector to determine an adjustment for the selectively adjustable flow control device.

10. The resource recovery and exploration system according to claim 9, wherein the distributed sensor comprises a fiber optic sensor.

11. The resource recovery and exploration system according to claim 9, wherein the distributed sensor comprises at least one of a distributed acoustic sensing (DAS) system and a distributed temperature sensing (DTS) assembly.

12. The resource recovery and exploration system according to claim 9, wherein the at least one selectively adjustable flow control device includes a selectively shiftable sleeve.

13. The resource recovery and exploration system according to claim 9, wherein the processing device is configured to detect a breakthrough of an injected fluid into the collector based on the parameter profile.

* * * * *